United States Patent [19]

Kawai et al.

[11] Patent Number: 4,599,109

[45] Date of Patent: Jul. 8, 1986

[54] HIGH HARDNESS AND HIGH TOUGHNESS NITRIDING POWDER METALLURGICAL HIGH-SPEED STEEL

[75] Inventors: Nobuyasu Kawai, Kobe; Minoru Hirano, Nishinomiya; Hiromune Manto, Kobe; Hajime Esaka, Akashi; Hirofumi Fujimoto, Ono, all of Japan

[73] Assignee: Kabushiki Kaisha Kobe Seiko Sho, Kobe, Japan

[21] Appl. No.: 746,124

[22] Filed: Jun. 18, 1985

[30] Foreign Application Priority Data

Jun. 20, 1984 [JP] Japan ..... 59-128288

[51] Int. Cl.[4] ..... C22C 29/04

[52] U.S. Cl. ..... 75/238; 75/230; 75/244; 75/126 A; 75/126 C; 75/126 E; 75/126 H; 75/126 J

[58] Field of Search ..... 419/42, 49; 75/126 A, 75/126 C, 126 E, 126 H, 126 J, 251, 238, 230, 244

[56] References Cited

U.S. PATENT DOCUMENTS 4,032,302 6/1977 Nakamura et al. ..... 75/240

4,249,945 2/1981 Haswell et al. ..... 75/241

4,263,046 4/1981 Fichte et al. ..... 75/237

*Primary Examiner*—Stephen J. Lechert, Jr.

*Attorney, Agent, or Firm*—Oblon, Fisher, Spivak, McClelland & Maier

[57] ABSTRACT

A high-speed steel obtained by powder metallurgy processing having a chemical composition which includes, in weight %, C: a quantity (%) which satisfies the formula $$Ceq+0.15 \leqq C+12/14\ N \leqq Ceq+0.35$$

where $Ceq=0.19+0.017\ (W+2Mo)+0.22V$, and

N, W, Mo and V are respectively the content (%) in steel

| | |
|---|---|
| Cr: 3-5% | V: 4.0-6.0% |
| Mo: 8-12% | Co: 5-15% |
| W: 8-14% | N: 0.2-1.2% |

and the remainder is Fe, and (W+2Mo) is 27-32%, is disclosed.

4 Claims, 9 Drawing Figures

HIGH HARDNESS AND HIGH TOUGHNESS NITRIDING POWDER METALLURGICAL HIGH-SPEED STEEL

FIELD OF THE INVENTION

The present invention relates to high-speed steel (hereinafter referred to as "powder metallurgical high-speed steel") obtained by powder metallurgy processing. More particularly, this invention relates to powder metallurgical high-speed steel having high hardness and high wear resistance, excellent in adhesion wear resistance.

DESCRIPTION OF THE PRIOR ART

Recently, in working blanks, higher precision and lower cost are required. The required working conditions of working blanks such as higher hardness or higher speed of working speed have become more severe. Therefore, it has a tendency that use of high-speed steel is being converted into that of sintered hard alloy to produce cutting tools. It is however considered that for precision tools requiring easiness of machining and toughness, high hardness and high toughness high-speed steel tools and coating high-speed steel tools will be used also in future.

At present, AISI-M40 series have been developed for high hardness ($H_R$ C65–70) high-speed steel. In steel of this kind, 5 weight % (hereinafter referred merely to %) or more of Co is added to increase hardness to increase C%, and the V% is lowered to prevent toughness lowering. On the other hand, an attempt has been made in Japanese Patent Laid-Open Nos. 11810/79 to 11813/79 to add N as a chemical composition of high-speed steel thereby further enhancing various performances of high-speed steel, which attempt has been given attention to provide nitriding powder metallurgical high-speed steel.

However, the aforesaid high hardness high-speed steel is produced by solving process, and therefore, segregation of carbide tends to occur, and heat treating condition is severe and hot workability is poor and in addition the content of V is low, because of which adhesion wear resistance is also poor. On the other hand, in the aforesaid nitriding powder metallurgical high-speed steel, an improvement in cutting performance is achieved without involving any problem of heat treatment or without adversely affecting on mechanical properties such as toughness but it involves a difficulty in terms of adhesion wear resistance. Furthermore, powder metallurgical high-speed steel having high hardness and high deflective strength is greatly desired to withstand severe cutting conditions.

SUMMARY OF THE INVENTION

The present invention has been achieved in view of the problems noted above and has its object to provide high hardness and high toughness powder metallurgical high-speed steel which is excellent in coagulant and abrasion resistance.

To achieve the aforementioned object, the present invention has taken the following means. That is, a chemical composition of powder metallurgical high-speed steel includes, by weight %, C: a quantity (%) which satisfies with the following formula $$Ceq+0.15 \leqq C+12/14N \leqq Ceq+0.35$$

where Ceq=0.19+0.017 (W+2Mo)+0.22V

N, W, Mo and V are respectively the content (%) in steel

| | |
|---|---|
| Cr: 3–5% | V: 4.0–6.0% |
| Mo: 8–12% | Co: 5–15% |
| W: 8–14% | N: 0.2–1.2% |

and the remainder is Fe, and (W+2Mo) is 27–32%.

DETAILED DESCRIPTION OF THE INVENTION AND PREFERRED EMBODIMENTS

Figure 1:
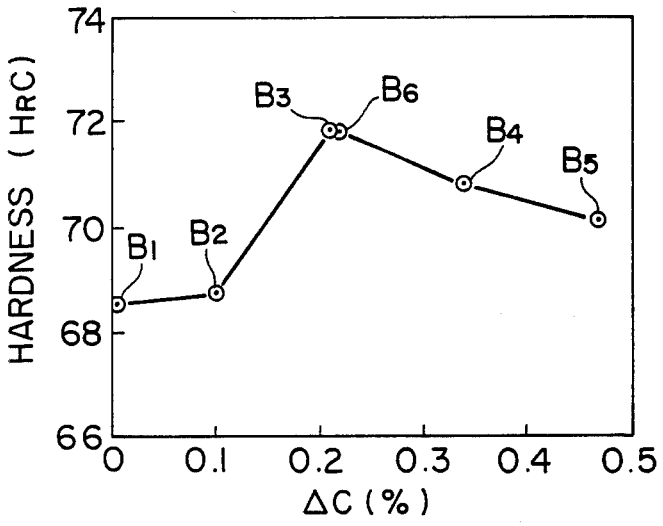
FIG. 1 is a view showing the relation between ΔC and hardness.

The nitriding powder metallurgical high-speed steel according to the present invention is composed of the aforementioned component elements. With respect to the composition range of these component elements limited reasons will be described hereinafter referring to specific embodiments.

C has a close relation with carbide forming elements such as Cr, Mo, W, V, etc. to greatly affect on the hardness, bending strength and the like of high-speed steel. Therefore, the C content should be determined in consideration of relation with the compounding quantity of the carbide forming elements, particularly, Mo, W and V. For example, "IRON AND STEEL" (Vol. 45, No. 5, pp. 511–516) discloses the following formula:

$$Ceq=0.19+0.017\ (W+2Mo)+0.22V$$

In this technical field, it is not substantially possible to employ that the C content is determined without consideration of relation with W, Mo and V (the above-described formula is a calculation formula with Cr held constant at about 4%). It is to be noted that the N content is also considered for such determination. which will be described hereinafter.

N has properties similar to those of C as an alloy element. In particular, both N and C have small atomic weights, 12 and 14, and are penetrating type atoms with respect to steel and therefore tend to form stabilized alloy compounds. Therefore. under the intention of the present invention requiring to contain much N, a conclusion was reached to the effect that the quantity of C and that of N should be related each other to establish the contents of both elements rather than independent adjustment of the N content.

The following experiments were conducted for the purpose of obtaining a given object along the line as described above.

Powder steel composed of an alloy composition as shown in Table 1 was produced by gas atomizing process and subjected to nitriding, after which a fine billet was obtained by so-called HIP. This billet was used as a specimen to obtain highest heat treating hardness and deflective strength thereof, results of which are given in FIGS. 1 and 2.

It is to be noted that in Table 1, there is an equation:

$$\Delta C=(C+12/14N)-Ceq$$

because it is considered that C and N are elements having substantially the same effect in this technical field as previously mentioned and they can be regarded equal to each other if a difference in atomic weight is converted.

TABLE 1

| Specimen | Chemical Components (Weight %) | | | | | | | | |
|---|---|---|---|---|---|---|---|---|---|
| | C | N | Cr | W | Mo | V | Co | Ceq | ΔC |
| B1 | 1.79 | 0.04 | 4.01 | 11.96 | 9.03 | 4.87 | 11.98 | 1.77 | 0.05 |
| B2 | 1.75 | 0.19 | 4.10 | 11.41 | 8.99 | 5.09 | 12.20 | 1.81 | 0.10 |
| oB3 | 1.75 | 0.31 | 4.10 | 11.41 | 8.99 | 5.09 | 12.20 | 1.81 | 0.21 |
| oB4 | 1.79 | 0.37 | 4.10 | 11.96 | 9.03 | 4.87 | 11.98 | 1.77 | 0.34 |
| B5 | 1.79 | 0.53 | 4.10 | 11.41 | 9.03 | 4.87 | 11.98 | 1.77 | 0.47 |
| B6 | 2.01 | 0.04 | 4.03 | 11.55 | 8.99 | 5.11 | 12.10 | 1.82 | 0.22 |

Note:
1 The remainder is substantially Fe.
2 Specimen marked by the symbol "circle" corresponds to the powder metallurgical high-speed steel according to the present invention.

Figure 2:
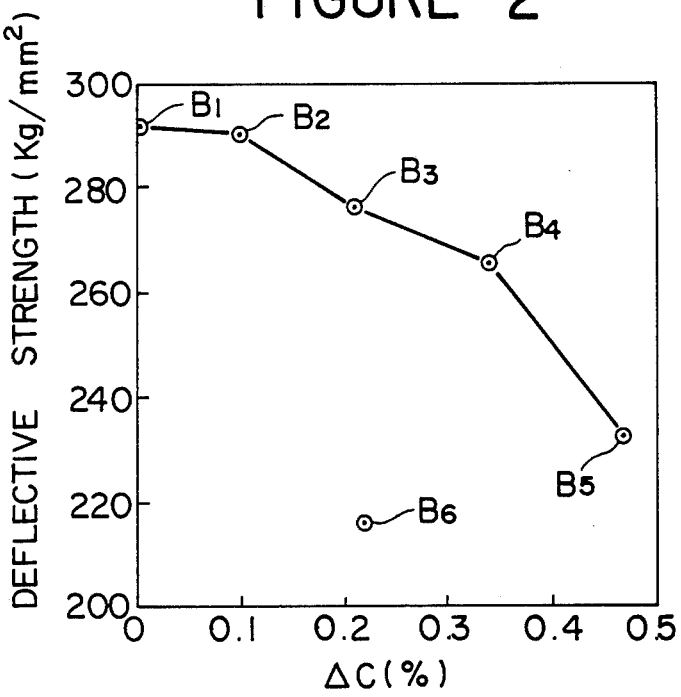
FIG. 2 is a view showing the relation between ΔC and bending strength.

It has been found from FIGS. 1 and 2 that if ΔC is 0.15% to 0.35%, high hardness ($H_RC$ 70 or more) and high toughness (bending strength, 260 kg/mm$^2$ or more) are obtained.

Figure 3:
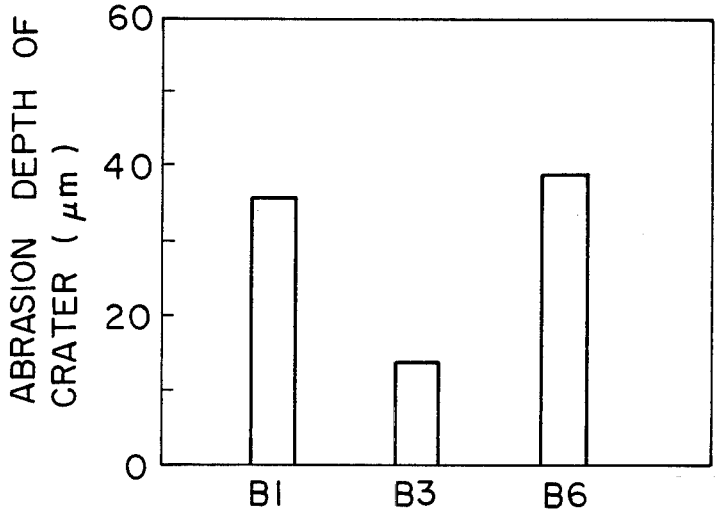
FIG. 3 is a view showing the depth of crater wear in a cutting test.

Further, cutting tools are trially produced from blanks, B1, B3 and B6 shown in Table 1, and a cutting test was carried out with SNCM 439 used as a workpiece, and the crater abrasive depth of the cutting tool as shown in FIG. 3 resulted. The cutting conditions were as shown below.

| | | | |
|---|---|---|---|
| Cutting speed: | 20 m/min. | Cutting length: | 200 m |
| Cut-in: | 1.5 mm | Feed: | 0.2 mm/rev. |
| Lubricant: | None | | |

As can be seen from FIG. 3, ones which are small in depth of crater wear are limited to those in which N content is more than 0.2%, and B6 in which N content is 0.04% has the crater abrasion about twice of B3 which is substantially equal in hardness.

Since N is coupled to V to form a vanadium nitride (VN), it need be contained in balance with the V content. The proportion of weight of N in the VN is 0.2, and in case the present invention, the maximum content of V is 6% as described later, and therefore, the upper limit of the N content is $6\times0.2=1.2\%$. Even if N in excess of 1.2% is contained, there brings forth no effect, and conversely, deterioration in fatigue undesirably results.

Cr is effective to prevent softening and oxidation at high temperatures. Cr less than 3% brings forth less effect previously described whereas if it exceeds 5%, said effect results but deterioratio in toughness undesirably results.

The W equivalent (W+2Mo) is controlled to a predetermined value to secure hardness. If the W equivalent is less than 27%, it becomes difficult to secure hardness above $H_R$ 70, whereas it exceeds 32%, the toughness lowers. If W is less than 8%, the heat resistance lowers whereas if it exceeds 14%, the toughness undesirably lowers.

Mo is contained in balance with W but in case of the present invention, if Mo is less than 8%, the heat resistance undesirably lowers whereas if it exceeds 12% the toughness undesirably lowers.

V is contained to provide an abrasion resistance, and if V is less than 4%, the abrasion resistance lowers whereas if it exceeds 6%, grinding property becomes worsened.

Co is contained to enhance hardness. If Co less than 5% is contained, the aforesaid effect is small, whereas if it exceeds 15%, the toughness materially lowers, which is not favorable.

In order to examine mechanical properties in terms of W equivalent, and contents of V and Co, powder steel composed of alloy composition shown in Table 2 and powder steel in the previously mentioned Table 1 B3 were produced by gas atomizing process, and they were subjected to nitriding, after which a fine billet was prepared by HIP to examine hardness, bend strength and the like. The results are given in FIGS. 4 to 9.

TABLE 2

| Specimen | Chemical Components (Weight %) | | | | | | | | |
|---|---|---|---|---|---|---|---|---|---|
| | C | N | Cr | W | Mo | V | Co | Ceq | ΔC |
| B7 | 1.68 | 0.22 | 4.16 | 11.51 | 5.98 | 4.87 | 12.13 | 1.66 | 0.21 |
| oB8 | 1.67 | 0.30 | 4.31 | 11.32 | 8.23 | 4.75 | 11.41 | 1.71 | 0.22 |
| B9 | 1.79 | 0.31 | 3.87 | 12.95 | 10.41 | 4.94 | 11.86 | 1.85 | 0.21 |
| B10 | 1.49 | 0.21 | 4.01 | 11.85 | 8.97 | 3.41 | 11.88 | 1.42 | 0.23 |
| oB11 | 1.78 | 0.51 | 3.78 | 12.77 | 8.45 | 5.85 | 12.43 | 1.98 | 0.24 |
| B12 | 1.99 | 0.48 | 3.88 | 12.93 | 8.86 | 6.84 | 12.35 | 2.20 | 0.20 |
| B13 | 1.78 | 0.35 | 4.11 | 11.79 | 9.05 | 5.31 | 0.88 | 1.87 | 0.21 |
| oB14 | 1.71 | 0.37 | 4.14 | 11.14 | 9.51 | 5.03 | 6.76 | 1.81 | 0.22 |
| B15 | 1.69 | 0.36 | 4.07 | 12.66 | 8.48 | 4.95 | 19.87 | 1.78 | 0.22 |

Note:
1 The remainder is substantially Fe.
2 Specimen marked by the symbol "circle" corresponds to the powder metallurgical high-speed steel according to the present invention.

Figure 4:
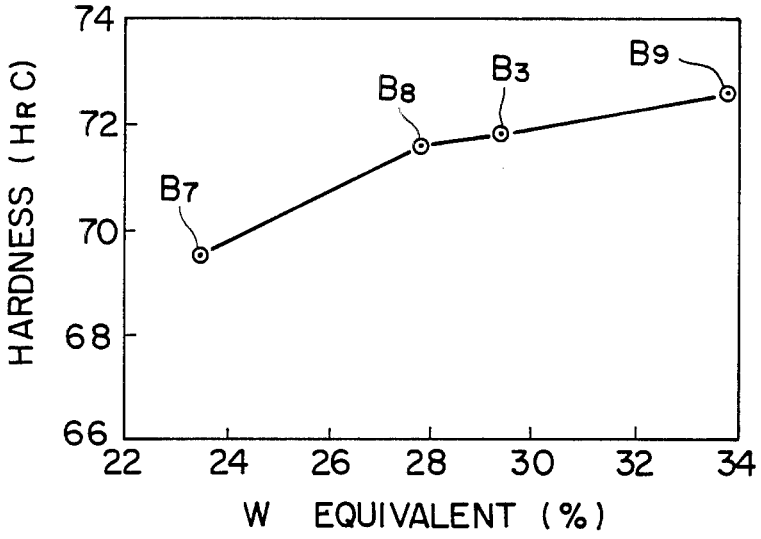
FIG. 4 is a view showing the relation between W equivalent and hardness.
Figure 5:
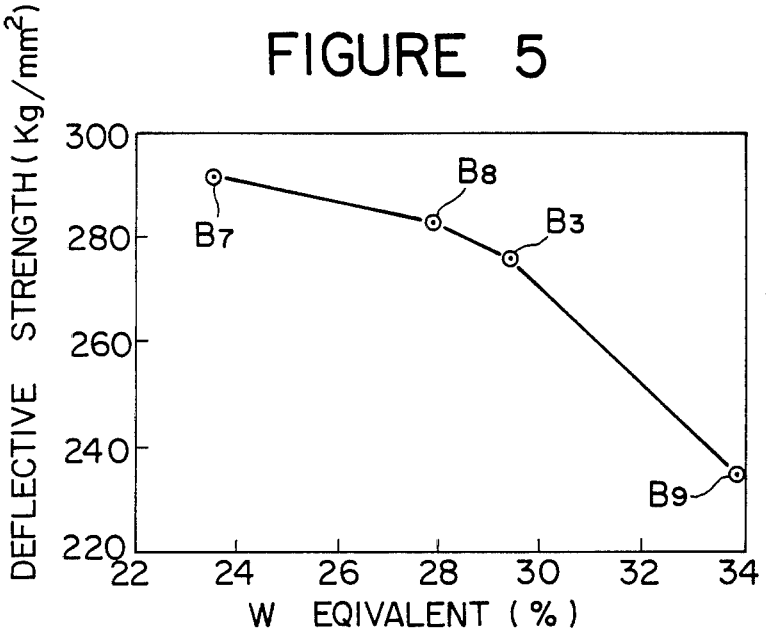
FIG. 5 is a view showing the relation between W equivalent and bending strength.

FIGS. 4 and 5 are respectively, views showing the relation between W equivalent (W+2Mo), hardness and deflective strength. B3 (W equivalent: 29.39%) and B8 (W equivalent: 27.78%) show good values, i.e., hardness $H_RC$—above 70 and bending strength—above 270 kg/mm$^2$. However, B7 whose W equivalent is 23.47% which is below a stipulated value has a hardness slightly lower than $H_RC$ 70 whereas B9 whose W equivalent is 33.77% which is above a stipulated value has a hardness above $H_RC$ 72 which is extremely favorable but the bending strength abruptly lowers to a value below 240 kg/mm$^2$.

Figure 6:
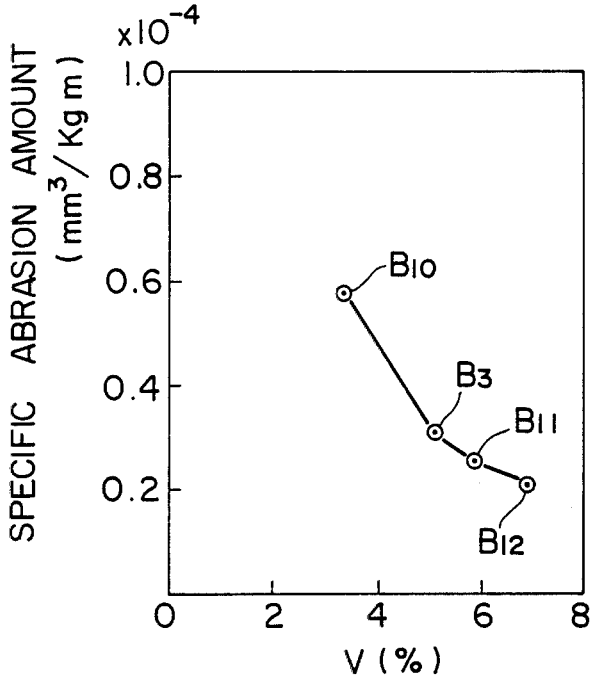
FIG. 6 is a view showing the relation between V content and wear rate.
Figure 7:
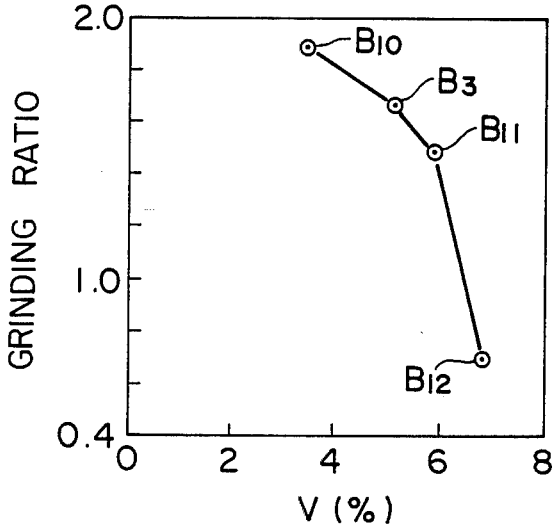
FIG. 7 is a view showing the relation between V content and grinding ratio.

FIGS. 6 and 7 are respectively views showing the relation between V content, wear rate and grinding ratio. B3 (V: 5.09%) and B11 (V: 5.85%) have a wear rate—below $0.3\times10^{-4}$ mm$^2$/kg.m and grinding ratio (actual grinding amount/grinding wheel abrasion amount)—above 1.4, which are favorable values whereas B10 whose V is 3.41% which is below a stipulated value has a great wear rate and B12 whose V is 6.84% which is above a stipulated value has a abruptly worsened grinding ratio. Here, the specific abrasion amount was measured by an OHGOSHI type wear test under the conditions of a mating material SNCM 439, final load—6.3 kg, friction distance—400 m and no-lubricant, and the grinding ratio was measured by a grinding test under the conditions of a grinding wheel GC36, wheel rotating speed—1800 m/sec, work rotating speed—18 m/sec and depth of cut—10 μm.

Figure 8:
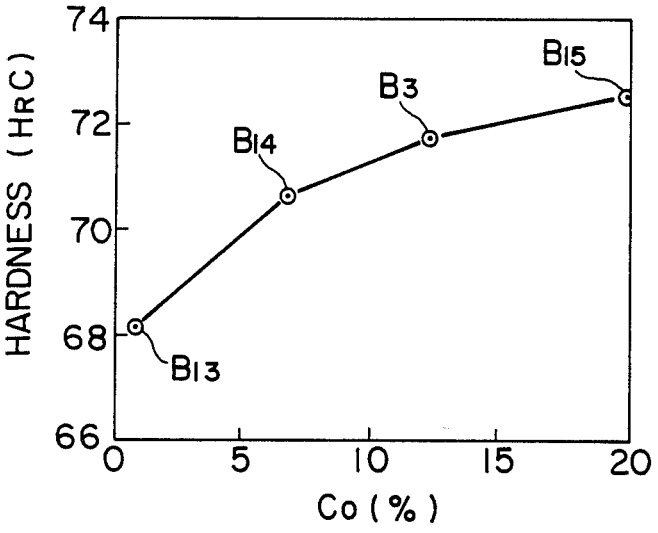
FIG. 8 is a view showing the relation between Co content and hardness.
Figure 9:
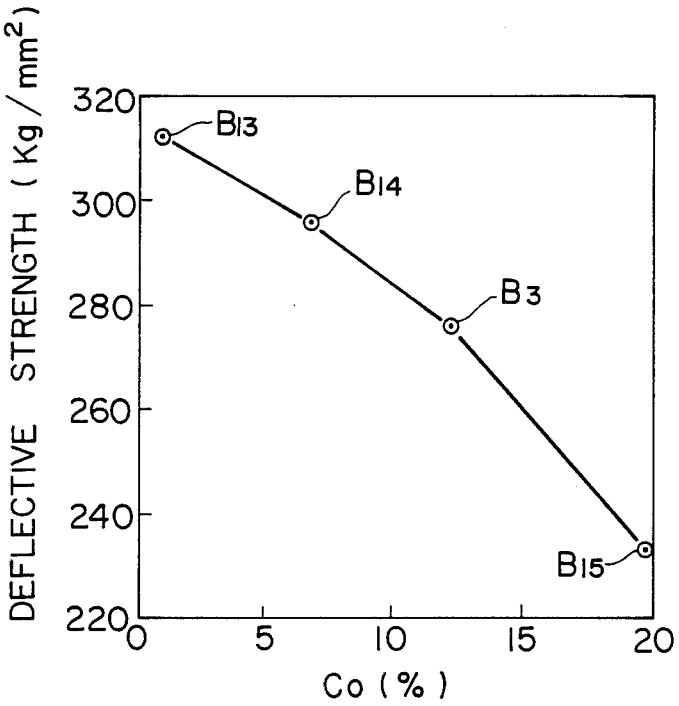
FIG. 9 is a view showing the relation between Co content and bending strength.

FIGS. 8 and 9 are respectively views showing the relation between Co content, hardness and deflective strength. B3 (Co: 12.20%) and B14 (Co: 6.76%) according to the present invention have a hardness—above $H_RC$ 70 and a bending strength—above 270 kg/mm$^2$ which are favorable values whereas B13 whose Co is 0.88% which is below a stipulated value lowers in hardness to a value in the vicinity of $H_RC$ 68, and B15 whose Co is 19.87% which is above a stipulated value materially lowers in bending strength to a value below 240 kg/mm$^2$.

As described above, in the nitriding powder metallurgical high-speed steel according to the present invention, C% is determined in connection with N% and Ceq and other alloy components are also determined to a predetermined value. Therefore, the high-speed steel of the invention is excellent in adhesion wear resistance and has a hardness above $H_RC$ 70 which is close to that of sintered hard alloy and high toughness of bend strength above 260 kg/mm$^2$.

What is claimed is:

1. A high hardness and high toughness nitriding powder metallurgical high-speed steel comprising, in weight %, C: in a quantity (%) which satisfies formula $$Ceq+0.15 \leqq C+12/14N \leqq Ceq+0.35$$

where Ceq=0.19+0.017(W+2Mo)+0.22V, and N, W, Mo and V are respectively the content (%) in steel:

| | |
|---|---|
| Cr: 3–5% | V: 4.0–6.0% |
| Mo: 8–12% | Co: 5–15% |
| W: 8–14% | N: 0.2–1.2% |

and the remainder is Fe, and (W+2Mo) is 27–32%.

2. The high-speed steel of claim 1, wherein (W+2Mo), the W equivalent is from 28% to 30%.

3. The high-speed steel of claim 1, wherein the content of V is 4.5% to 5.5%.

4. The high-speed steel of claim 1, wherein the content of Co is 10% to 14%.

* * * * *